US005192227A

United States Patent [19]

Bales

[11] Patent Number: 5,192,227

[45] Date of Patent: Mar. 9, 1993

[54] DIN RAIL MOUNTING BRACKET

[75] Inventor: Ronald K. Bales, Raleigh, N.C.

[73] Assignee: Square D Company, Palatine, Ill.

[21] Appl. No.: 811,728

[22] Filed: Dec. 23, 1991

[51] Int. Cl.[5] ..... H01R 13/60

[52] U.S. Cl. ..... 439/532; 439/716

[58] Field of Search ..... 439/532, 716–725

[56] References Cited

U.S. PATENT DOCUMENTS

| | | | |
|---|---|---|---|
| 2,983,897 | 5/1961 | Blanchet | 439/722 X |
| 4,390,230 | 6/1983 | Knickerbocker | 439/716 X |
| 4,921,445 | 5/1990 | Herbert | 439/716 X |

FOREIGN PATENT DOCUMENTS

| | | | |
|---|---|---|---|
| 2351530 | 4/1975 | Fed. Rep. of Germany | 439/716 |
| 3732267 | 9/1988 | Fed. Rep. of Germany | 439/716 |

*Primary Examiner*—Eugene F. Desmond

*Attorney, Agent, or Firm*—Larry I. Golden; Michael J. Femal; Larry T. Shrout

[57] ABSTRACT

The present invention discloses an apparatus for adapting an electronic or electrical device enclosure for mounting on a DIN mounting rail having two opposed outwardly extending flanges. The apparatus comprises a DIN mounting rail bracket having provisions for attaching to the enclosure of the electrical or electronic device. The mounting rail bracket is provided with a hook for receiving a portion of one of the outwardly extending flanges of the DIN rail. The mounting rail bracket is also provided with a selectively operable locking and releasing mechanism opposite the hook for locking onto and releasing from a portion of the other outwardly extending flange of the DIN rail.

7 Claims, 5 Drawing Sheets

DIN RAIL MOUNTING BRACKET

FIELD OF THE INVENTION

The invention relates to mounting brackets for use with electrical or electronic devices, and more specifically, to mounting brackets for attaching devices to DIN rails.

BACKGROUND OF THE INVENTION

Most electrical or electronic device enclosures including photoelectric sensor enclosures are provided with holes for attaching to a mounting bracket. The mounting bracket is generally an L-shaped bracket designed for mounting the device to a flat surface. These L-shaped brackets generally include holes on one leg for attaching to the device enclosure and holes on the other leg for attaching to the mounting surface. Devices which have provisions for mounting on DIN rails have had these provisions incorporated as an integral part of the device enclosure. Mounting on a DIN rail requires locking mechanism and a release mechanism which generally includes a movable or flexible part which can be released from the mounting rail. Rymer U.S. Pat. No. 3,992,074 discloses a flexible latching member formed as an integral part of the device while the Idec Corporation model FFR 1H OPTO FIBER SENSOR incorporates a sliding latch retained by a spring which permits it to engage and disengage the DIN mounting rail. By incorporating the DIN mounting rail provisions as a part of the device enclosure the manufacturing cost of the device is increased. In many instances manufacturing time is also increased since some assembly may be required to install the release mechanism parts to the device enclosure.

SUMMARY OF THE INVENTION

It is an objective of the present invention to provide an inexpensive mounting bracket which may be used for attaching the enclosures of various electrical or electronic devices including photoelectric sensors to a DIN mounting rail. The DIN rail mounting bracket of the present invention is designed to use the same mounting holes provided on an electrical or electronic device enclosure for attaching to a standard L-shaped mounting bracket.

Other features and advantages of the invention will become apparent to those skilled in the art upon review of the following detailed description, claims and drawings.

Figure 1:
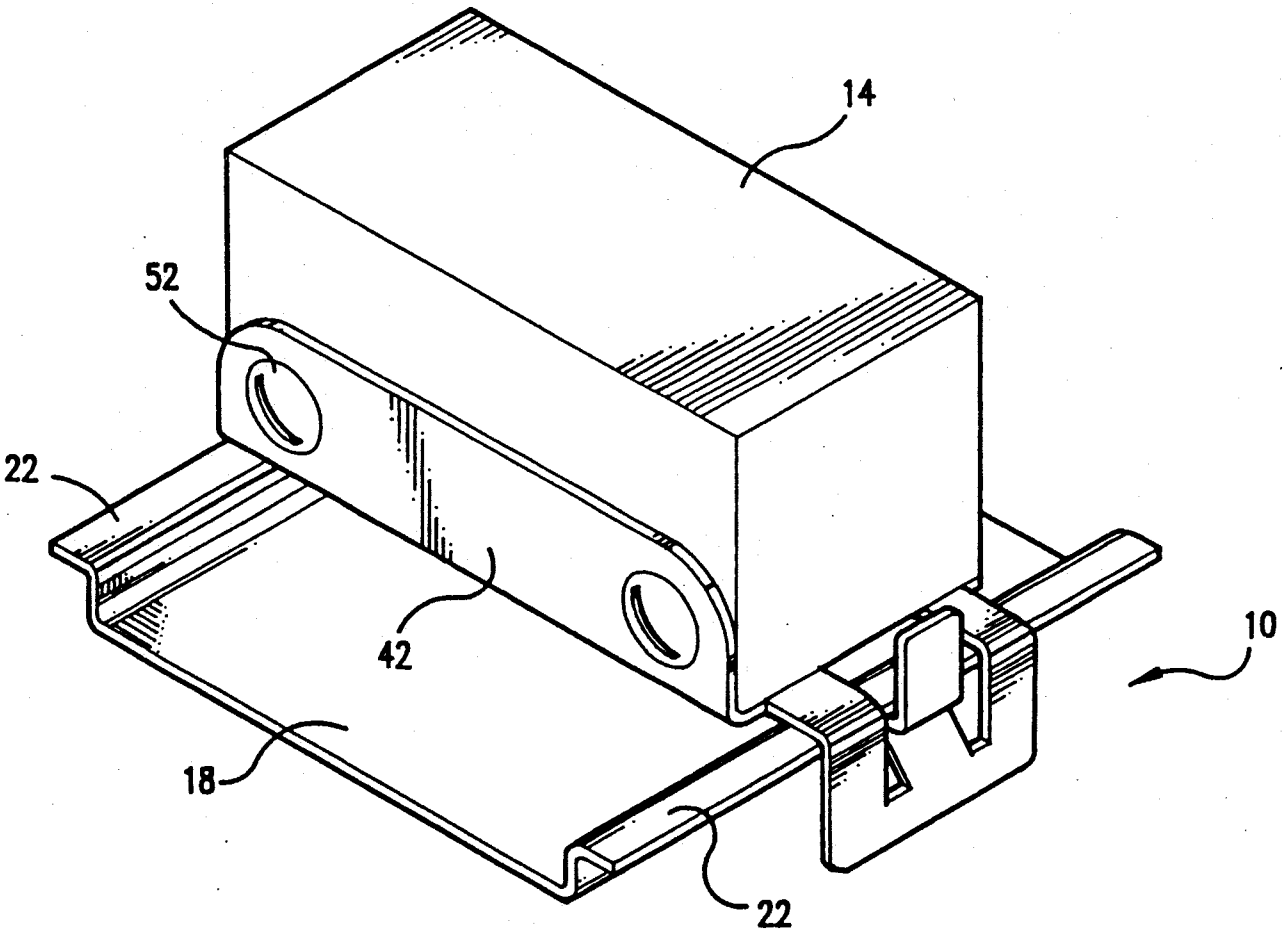
FIG. 1 is an isometric view of an electronic device attached to a DIN rail mounting bracket installed on a DIN rail.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

Figure 2:
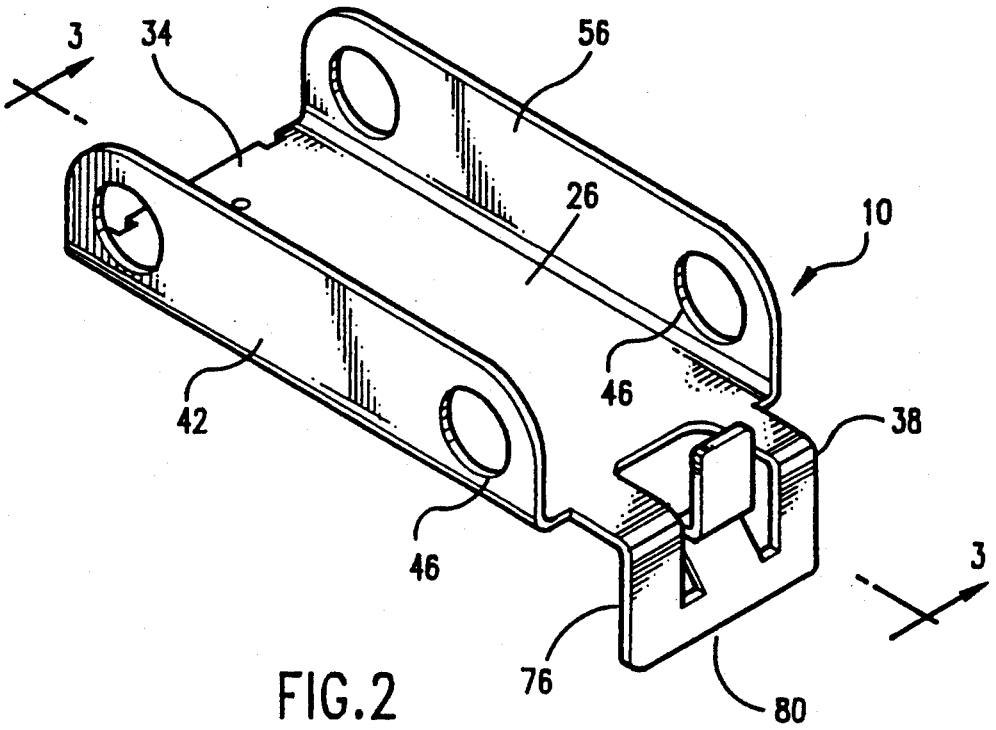
FIG. 2 is an isometric view of a DIN rail mounting bracket having two device mounting flanges.

The apparatus of the present invention comprises a mounting bracket 10 for mounting an electrical or electronic device enclosure 14 to a DIN rail 18. The DIN rail 18 is generally U-shaped and includes two opposed, outwardly extending flanges 22 on which devices may be attached. The mounting bracket 10 is generally rectangular in shape and has a top surface 26, a bottom surface 30, a first end 34 second end 38, and a mounting flange 42. The first and second ends 34 and 38 respectively are generally parallel to and spaced apart from one another. The mounting flange 42 extends outwardly from and perpendicularly to the top surface 26 along a longitudinal edge of the top surface 26. The mounting flange 42 is also perpendicular to the first and second ends 34 and 38 respectively. The mounting flange 42 is provided with a number of holes 46 for the purpose of attaching the mounting bracket 10 to the device enclosure 14 by means such as screws 52. As shown in FIG. 2, it may be desirable to have a second mounting flange 56 parallel to and spaced apart from the mounting flange 42. The first end 34 of the mounting bracket 10 includes a J-shaped hook 60. The hook 60 includes a long side which is also the bottom surface 30 of the mounting bracket 10 and a short side 64 which is generally parallel to and spaced apart from the bottom surface 30 and includes an end 68 which points generally toward the second end 38 of the bracket 10. The hook 60 receives a portion of one of the outwardly extending flanges 22 of the DIN rail 18 in the space between the bottom surface 30 and the short side 64. The mounting bracket 10 is permitted to rotate slightly around that portion of the flange 22 received within the hook 60. A small dimple 72 projects downward from the bottom surface 30 at a point slightly beyond the end 68 of short side 64 of the hook 60. As the mounting bracket 10 is rotated around the flange 22 the dimple 72 engages the flange 22 causing frictional interference between the dimple 72, the short side 64 of the hook 60 and the flange 22. This interference prevents the bracket from sliding linearly along the DIN rail 18. The second end 38 of the mounting bracket 10 includes a flange 76 extending outwardly from and perpendicularly to the bottom surface 30 of the mounting bracket 10. The flange 76 has a distal end 80 and includes an integrally formed flexible latching member 84. The latching member 84 includes an inclined surface 88, a latch surface 92, and a release lever 96. The inclined surface 88 has a first end 100 pivotally attached to the distal end 80 of flange 76 and a second end 104, the inclined surface 88 forms an acute angle with flange 76. The latch surface 92 is generally parallel to and spaced apart from the bottom surface 30 of the mounting bracket 10 approximately the same distance as the short side 64 of the hook 60.

The latch surface 92 has a first end 108 integrally connected to the second end 104 of the inclined surface 88 and a second end 112. The release lever 96 is generally perpendicular to the latch surface 92, parallel to the flange 76 and is integrally connected to the second end 112 of the latch surface 92. The release lever 96 extends upward beyond the top surface 26.

During installation of the mounting bracket 10 onto the DIN rail 18 a portion of one of the flanges 22 is inserted into the hook 60 and the mounting bracket 10 is rotated onto the DIN rail 18. As the mounting bracket 10 is rotated onto the DIN rail 18 the inclined surface 88 engages the outermost edge of the other flange 22 causing the latching member 84 to be flexed outwardly. This flexing movement allows the flange 22 to slide along the inclined surface 88 until it reaches the second end 104 of the inclined surface 88. As the flange 22 passes the second end 104 of the inclined surface 88 the latching member 84 flexes inwardly permitting the latch surface 92 to engage the flange 22 thereby locking the mounting bracket 10 onto the DIN rail 18.

Figure 3:
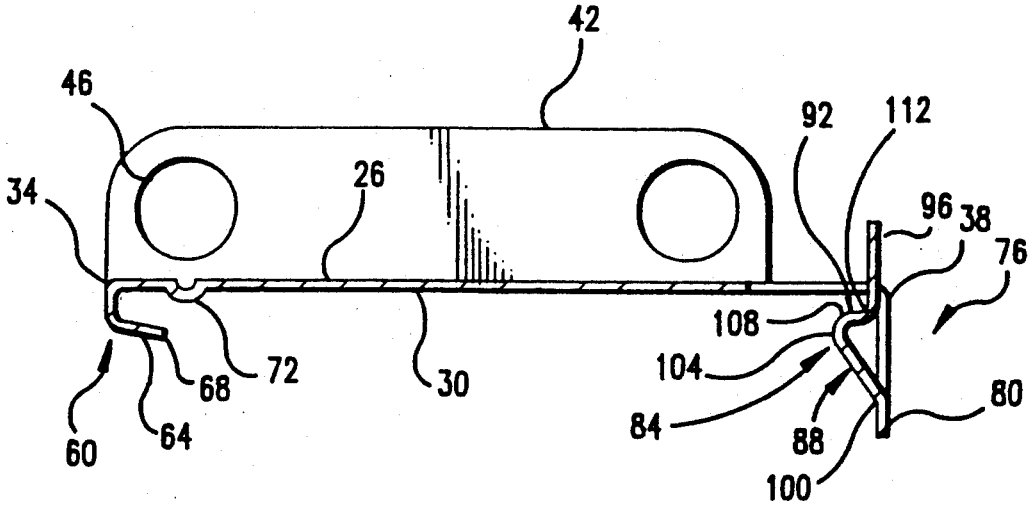
FIG. 3 is a cross-section view taken along line 3—3 of FIG. 2 of the DIN rail mounting bracket.
Figure 3A:
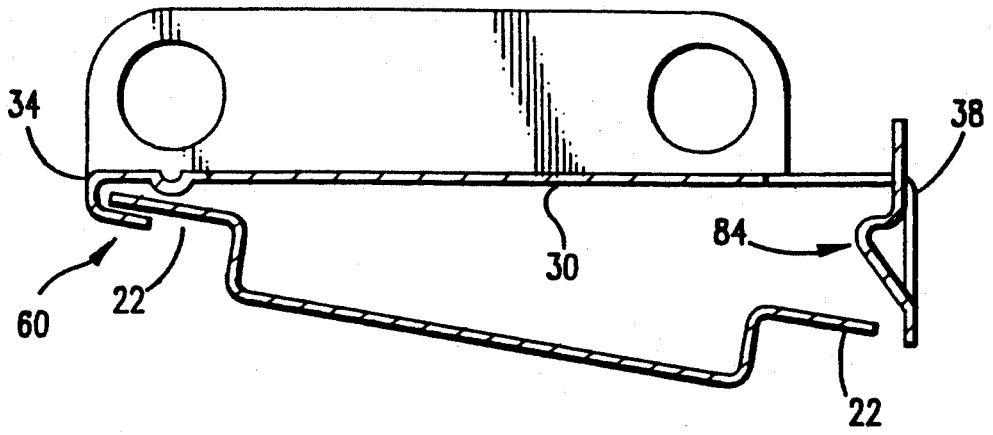
FIG. 3A is a cross-section view of a mounting bracket prior to installation on a DIN mounting rail.
Figure 3B:
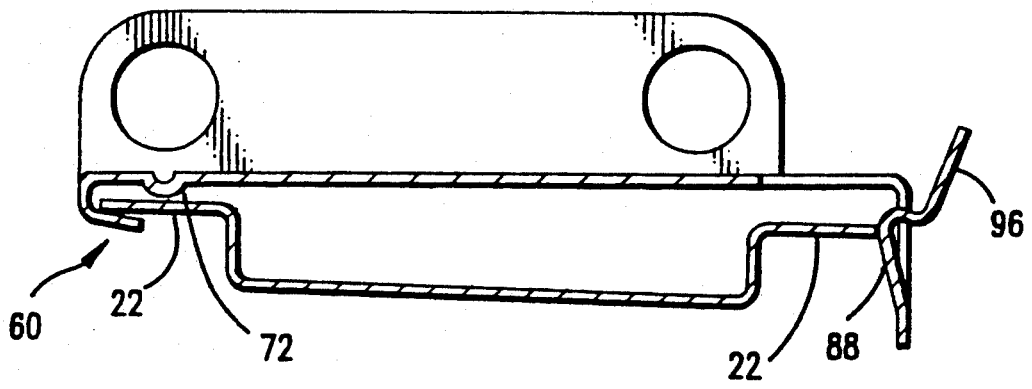
FIG. 3B is a cross-section view of a mounting bracket during installation onto a DIN mounting rail.
Figure 3C:
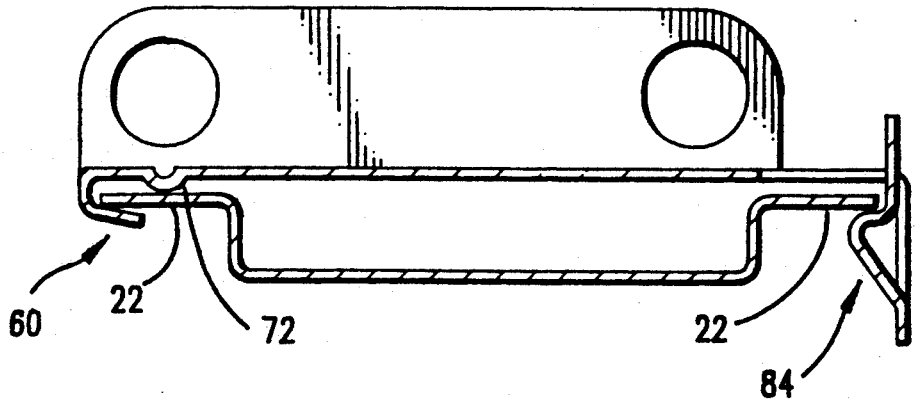
FIG. 3C is a cross-section view of a mounting bracket after installation on a DIN mounting rail.
Figure 4:
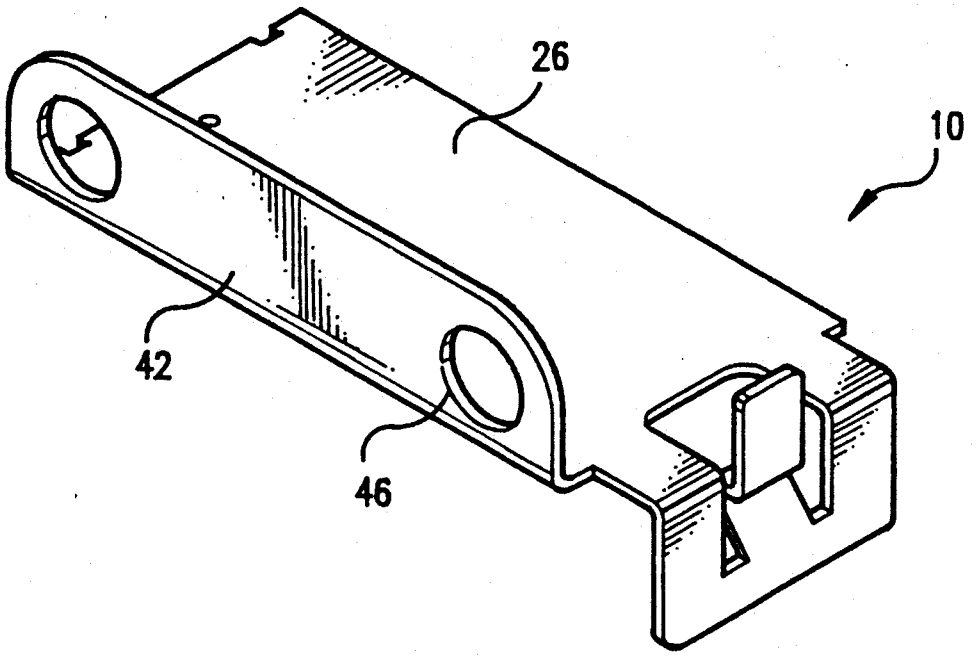
FIG. 4 is an alternate construction of the DIN mounting rail bracket having one device mounting flange.

To remove the mounting bracket 10 from the DIN rail 18 the release lever 96 must be manually moved in a direction away from the flange 22 of the DIN rail 18. This movement causes the latching member 84 to flex outwardly permitting the latch surface 92 to disengage the flange 22. With the latch surface 92 disengaged the mounting bracket 10 may be rotated off of the DIN rail 18. The latch surface 92 is normally in an engaged position as shown in FIGS. 3A and 3C but may be selectively moved to a disengaged position as shown in FIG. 3B by forcing the inclined surface 88 outwardly during installation or by selectively moving the release lever 96 outwardly during removal.

Figure 5:
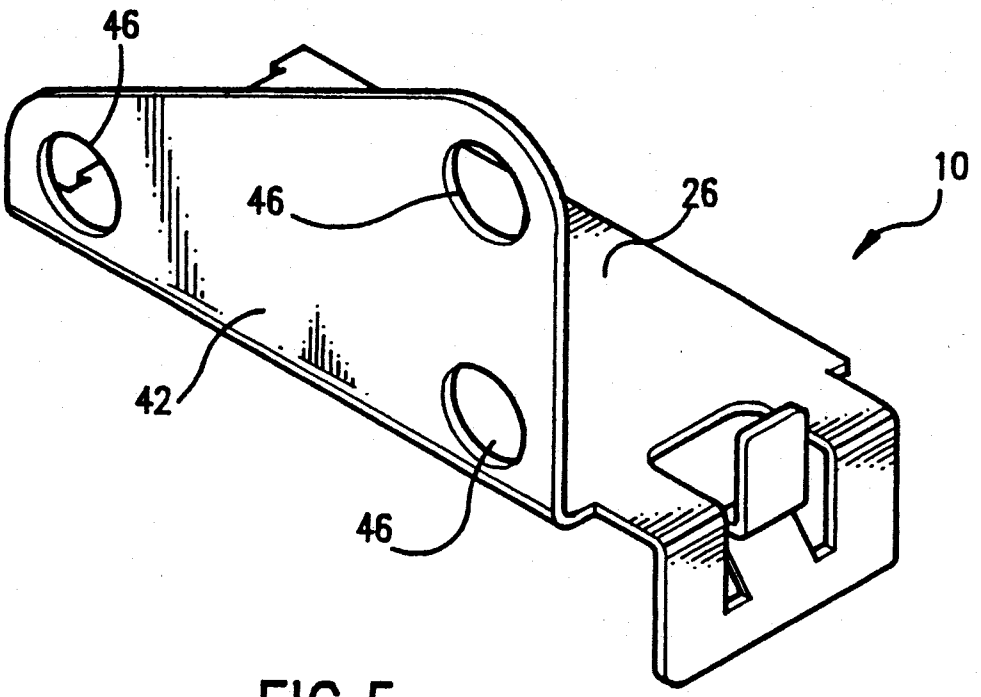
FIG. 5 is an alternate construction of the DIN mounting rail bracket having an additional hole for mounting electronic devices.

An alternate mounting bracket construction is shown in FIG. 5 wherein the mounting flange 42 has a different shape and hole pattern for mounting other electrical or electronic devices.

I claim:

1. An apparatus for adapting an electrical or electronic device enclosure to be mounted on a DIN rail having two opposed outwardly extending flanges, said apparatus comprising:

a bracket, generally rectangular in shape, having a top surface, a bottom surface, a first end, a second end generally parallel to and spaced apart from said first end, at least one mounting flange having apertures therein for receiving means for attaching to the electrical or electronic device enclosure, and means for rotatively attaching to the DIN rail and means for selectively releasing from the DIN rail.

2. The apparatus of claim 1 wherein said mounting flange extends from said first end of said bracket to a point near said second end of said bracket and is generally perpendicular to said first and second ends and extends outwardly from and perpendicularly to said top surface.

3. The apparatus of claim 2 wherein said means for rotatively attaching to said DIN rail further includes:

a generally J-shaped hook at said first end, said hook having a long side common with said bottom surface, a short side spaced apart from said long side and having an end generally facing said second end of said bracket, said hook receives a portion of one of the two opposed outwardly extending flanges of the DIN rail in the space between said long and short sides.

4. The device of claim 3 wherein a dimple projects downwardly from said bottom surface at a point slightly beyond said end of said short side of said hook, said dimple engages the DIN rail flange causing a frictional interference between said dimple, said short side of said hook, and that portion of the flange received within said hook, thereby preventing said mounting bracket from sliding linearly along the DIN rail.

5. The apparatus of claim 3 wherein said second end includes a flange extending outwardly from and perpendicularly to said bottom surface of said bracket and terminating at a distal end.

6. The apparatus of claim 5 wherein said means for selectively releasing from the DIN rail comprises a flexible latching member having one end integrally connected to said distal end of said flange and another end extending upwardly above said top surface to provide leverage for flexing said latching member.

7. The apparatus of claim 6 wherein said flexible latching member further comprises:

(A) an inclined surface having a first end pivotably attached to said distal end of said flange, and a second end, said inclined surface forming an acute angle with said flange for slidably engaging the outermost edge of the DIN rail flange opposite that portion of the opposed DIN rail flange received within said hook such that the edge of the DIN rail flange causes the locking member to flex outwardly permitting the edge of the DIN rail flange to slidably pass along the inclined surface (B) a latch surface generally parallel to and spaced apart from said bottom surface of said mounting bracket a distance approximately equal to the distance between said short side of said hook and said bottom surface, said latch surface includes a first end integrally connected to said second end of said inclined surface and a second end (C) a release lever generally perpendicular to said latch surface and parallel to said flange, said release lever having one end integrally connected to said second end of said latch surface and another end extending upwardly beyond said top surface of said mounting bracket, said release lever being selectively movable causing said latch surface to move between an engaged position and a disengaged position.

* * * * *